US005500318A

United States Patent [19]

Tanikawa et al.

[11] Patent Number: 5,500,318

[45] Date of Patent: Mar. 19, 1996

[54] TONER FOR DEVELOPING ELECTROSTATIC IMAGE AND FIXING METHOD

[75] Inventors: Hirohide Tanikawa, Yokohama; Masaki Uchiyama, Ichikawa; Yoshinobu Joh, Kawasaki; Yasutaka Akashi, Yokohama; Masaaki Taya, Kawasaki; Makoto Unno, Tokyo, all of Japan

[73] Assignee: Canon Kabushiki Kaisha, Tokyo, Japan

[21] Appl. No.: 266,478

[22] Filed: Jun. 27, 1994

Related U.S. Application Data

[62] Division of Ser. No. 797,915, Nov. 26, 1991, Pat. No. 5,330,871.

[30] Foreign Application Priority Data

Nov. 29, 1990 [JP] Japan ..... 2-332691

[51] Int. Cl.[6] ..... G03G 13/20

[52] U.S. Cl. ..... 430/99; 430/109; 430/122; 430/126

[58] Field of Search ..... 430/99, 109, 122, 430/126

[56] References Cited

U.S. PATENT DOCUMENTS

| | | | |
|---|---|---|---|
| 2,297,691 | 10/1942 | Carlson | 95/5 |
| 3,666,363 | 5/1972 | Tanaka et al. | 355/17 |
| 4,071,361 | 1/1978 | Marushima | 96/1.4 |
| 4,499,168 | 2/1985 | Mitsuhashi | 430/99 |
| 4,565,763 | 1/1986 | Uchiyama et al. | 430/109 |
| 4,565,766 | 1/1986 | Mitsuhashi et al. | 430/126 |
| 4,939,000 | 7/1990 | Tomiyama et al. | 430/111 |
| 4,952,476 | 8/1990 | Sakashita et al. | 430/106.6 |

FOREIGN PATENT DOCUMENTS

| | | |
|---|---|---|
| 0393592 | 10/1990 | European Pat. Off. . |
| 51-23354 | 7/1976 | Japan . |
| 55-6805 | 2/1980 | Japan . |
| 56-116043 | 9/1981 | Japan . |
| 57-178249 | 11/1982 | Japan . |
| 57-178250 | 11/1982 | Japan . |
| 57-208559 | 12/1982 | Japan . |
| 60-123850 | 7/1985 | Japan . |
| 61-110156 | 5/1986 | Japan . |
| 61-170155 | 5/1986 | Japan . |
| 63-223662 | 9/1988 | Japan . |
| 63-217362 | 9/1988 | Japan . |
| 63-217363 | 9/1988 | Japan . |
| 63-214760 | 9/1988 | Japan . |
| 1-303447 | 12/1989 | Japan . |
| 1-309070 | 12/1989 | Japan . |

OTHER PUBLICATIONS

World Patents Index Latest, Week 9004, Derwent Public., for JPA 01–303447 (AN 90–025981).

World Patents Index Latest, Week 9005, Derwent Public., AN 90–032529 for JPA–01–309070.

*Primary Examiner*—S. Rosasco

*Attorney, Agent, or Firm*—Fitzpatrick, Cella, Harper & Scinto

[57] ABSTRACT

A toner for developing an electrostatic image is constituted by a binder resin and a colorant The binder resin is characterized by containing at least 20 wt. % of an extraction residue after 6 hours of extraction and below 20 wt. % of an extraction residue after 72 hours of extraction respectively by Soxhlet extraction with tetrahydrofuran. The toner shows a dynamic modulus and a loss modulus, respectively at 200° C. and 0.1 Hz, which are substantially unchanging with time. The properties provide the toner with a harmonization of anti-offset characteristic and fixability as well as stable viscoelasticity under heating.

33 Claims, 2 Drawing Sheets

TONER FOR DEVELOPING ELECTROSTATIC IMAGE AND FIXING METHOD

This application is a division of application Ser. No. 07/797,915 filed Nov. 26, 1991 now U.S. Pat. No. 5,330,871.

FIELD OF THE INVENTION AND RELATED ART

The present invention relates to a toner for developing electrostatic images used in image forming methods, such as electrophotography or electrostatic printing, particularly a toner suitable for hot roller fixation, and a fixing method using such a toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper etc., as desired, fixed by heating, pressing, or heating and pressing, or with solvent vapor to obtain a copy.

As for the step of fixing the toner image onto a sheet material such as paper which is the final step in the above process, various methods and apparatus have been developed, of which the most popular one is a heating and pressing fixation system using hot rollers.

In the heating and pressing system, a sheet carrying a toner image to be fixed (hereinafter called "fixation sheet") is passed through hot rollers, while a surface of a hot roller having a releasability with the toner is caused to contact the toner image surface of the fixation sheet under pressure, to fix the toner image. In this method, as the hot roller surface and the toner image on the fixation sheet contact each other under pressure, a very good heat efficiency is attained for melt-fixing the toner image onto the fixation sheet to afford quick fixation, so that the method is very effective in a high-speed electrophotographic copying machine. In this method, however, a toner image in a melted state is caused to contact a hot roller surface under pressure, so that there is observed a so-called offset phenomenon wherein a part of the toner image is attached and transferred to the hot roller surface and then transferred back to the fixation sheet to stain the fixation sheet. It has been regarded as one of the important conditions in the hot roller fixation system to prevent the toner from sticking to the hot roller surface.

In order to prevent a toner from sticking onto a fixing roller surface, it has been conventionally practiced to compose the roller surface of a material showing excellent releasability against the toner (e.g., silicone rubber or fluorine-containing resin) and further coating the surface with a film of a liquid showing a good releasability such as silicone oil so as to prevent offset and fatigue of the roller surface. This method is very effective for preventing offset but requires a device for supplying such an offset-preventing liquid, thus resulting in complication of the fixing apparatus.

Therefore, it is not necessarily desirable to prevent the offset by supplying an offset-preventing liquid, but a toner having a broad fixing temperature range and excellent in anti-offset characteristic is rather desired at present. For this reason, in order to provide a toner with an increased releasability, it has been also practiced to add a wax, such as low-molecular weight polyethylene or low-molecular weight polypropylene. The use of wax is effective in prevention of offset but, on the other hand, the wax is liable to provide the toner with an increased agglomeratability, an unstable chargeability and a deterioration in durability. Therefore, various proposals have been made for improving the binder resin.

For example, it is known to increase the glass transition temperature (Tg) and the molecular weight of a toner binder resin so as to improve the molten characteristic of the toner for the purpose of offset prevention.

Japanese Patent Publication (JP-B) 51-23354 has proposed a moderately crosslinked vinyl polymer by addition of a crosslinking agent and a molecular weight controller, and JP-B 55-6805 has proposed a toner composed from an α,β-ethylenically unsaturated monomer and having a broad molecular weight distribution represented by a weight-average molecular weight/number-average molecular weight ratio of 3.5–40. It has been also proposed to use a resin blend including a vinyl copolymer having specified Tg, molecular weight and gel content.

The toners by these proposals actually provide a fixable temperature range (defined as a difference between the offset-initiation temperature and the lowest fixable temperature) which is wider than that of a toner comprising a single resin having a narrow molecular weight distribution.

A toner obtained by crosslinking a polyester resin in place of vinyl resins as described above and adding an offset-preventing agent has also been proposed (JP-A 57-208559).

Further, JP-A 56-116043 has proposed a toner using a resin which is obtained by polymerizing a vinyl monomer in the presence of a reactive polyester resin to cause crosslinking, addition and grafting during the polymerization, thus providing a resin having an increased molecular weight.

JP-A 60-123850 has proposed a toner using a resin obtained by simply blending a polyester resin with two types of vinyl resins having a gel content of at least 20% and a gel content of below 10%. The toner shows a satisfactory fixability but the offset-preventing characteristic is insufficient. If the content of the vinyl resin having a gel content of at least 80% is increased in order to improve the anti-offset characteristic, the offset-preventing effect is improved but the fixability is lowered. On the other hand, it is impossible to provide a sufficient anti-offset characteristic by simply incorporating a vinyl resin having a gel content of below 10%.

It has been proposed to react a vinyl polymer having a carboxyl group with a metal compound to cause crosslinking by JP-A 57-178249, JP-A 57-178250, etc. It has been proposed to react a vinyl resin comprising a vinyl monomer and a special half ester compound with a polyvalent metal compound to cause crosslinking by JP-A 61-110155, JP-A 61-110156, etc. Further, JP-A 63214760, JP-A 63-217362, JP-A 63-217363, etc., have proposed to form a resin having a molecular weight distribution separated into two portions, i.e., a portion having a low molecular weight and a portion having a high molecular weight so that the low molecular weight portion is caused to contain a special half ester compound having a carboxyl group which is reacted with a polyvalent metal ion. However, at present, none of the above methods has succeeded in satisfying various properties required of a toner, particularly the anti-offset characteristic required in a high-speed machine.

In order to solve the above-mentioned problems, our research group has proposed the use of a special resin which has been prepared by adding a low-molecular weight resin during suspension polymerization (JP-A 63-223662). Even a toner prepared according to this proposal does not show a sufficient fixability when used in a high-speed copying machine operated at a high speed of 80 or more A4-size sheets/minute and is found to cause a toner flowout through a cleaning member abutted to the fixing roller, thus being liable to stain the transfer material such as paper.

In a high-speed machine exceeding 80 sheets/min, even if an offset amount per sheet is very slight, a considerable amount of offset residue can be accumulated on the fixing roller due to a large number of sheets passing therethrough, so that the fixing apparatus can cause problems. In order to remove the slight amount of offset residue, a fixer cleaning member such as a silicone rubber-made cleaning roller or a web is disposed abutting to the fixing roller. A conventional toner binder resin has been designed so as to provide a low-temperature fixability and an anti-offset characteristic and has not been designed so as to provide a high melt-viscosity even at as high a temperature as exceeding 200° C. Further, the toner material attached to the fixer cleaning member remains for a long period at a set temperature of the fixing roller to cause a lowering in melt viscosity. As a result, when the fixing roller temperature exceeds 200° C. due to overshooting in excess of the set temperature thereof, e.g., at the time of turning on the copying apparatus, the attached toner material causes a remarkable decrease in melt viscosity and is thus re-transferred to the fixing roller to stain the toner image-receiving sheet.

SUMMARY OF THE INVENTION

A generic object of the present invention is to provide a toner and a fixing method having solved the above-mentioned problems.

A more specific object of the present invention is to provide a toner and a fixing method free from toner flowout from a cleaning member for a fixer such as a fixing roller.

Another object of the present invention is to provide a toner and a fixing method showing sufficient anti-offset characteristic without impairing the fixability.

Another object of the present invention is to provide a toner and a fixing method showing excellent performances in successive copying on a large number of sheets.

According to the present invention, there is provided a toner for developing an electrostatic image, comprising: a binder resin and a colorant, wherein the binder resin contains at least 20 wt. % of an extraction residue after 6 hours of extraction and below 20 wt. % of an extraction residue after 72 hours of extraction respectively by Soxhlet extraction with tetrahydrofuran (THF), and the toner shows a dynamic modulus and a loss modulus, respectively at 200° C. and 0.1 Hz, which are substantially unchanging with time.

According to another aspect of the present invention, there is provided a fixing method comprising:

feeding a toner-receiving material carrying a toner image on a surface thereof, the toner comprising a binder resin and a colorant, wherein the binder resin contains at least 20 wt. % of an extraction residue after 6 hours of extraction and below 20 wt. % of an extraction residue after 72 hours of extraction respectively by Soxhlet extraction with tetrahydrofuran (THF), and the toner shows a dynamic modulus and a loss modulus, respectively at 200° C. and 0.1 Hz, which are substantially unchanging with time;

passing the toner-receiving material carrying the toner image between a heated fixing roller and a pressing roller to fix the toner image under heating and pressing onto the surface of the toner-receiving material; and cleaning the fixing roller surface with a cleaning member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
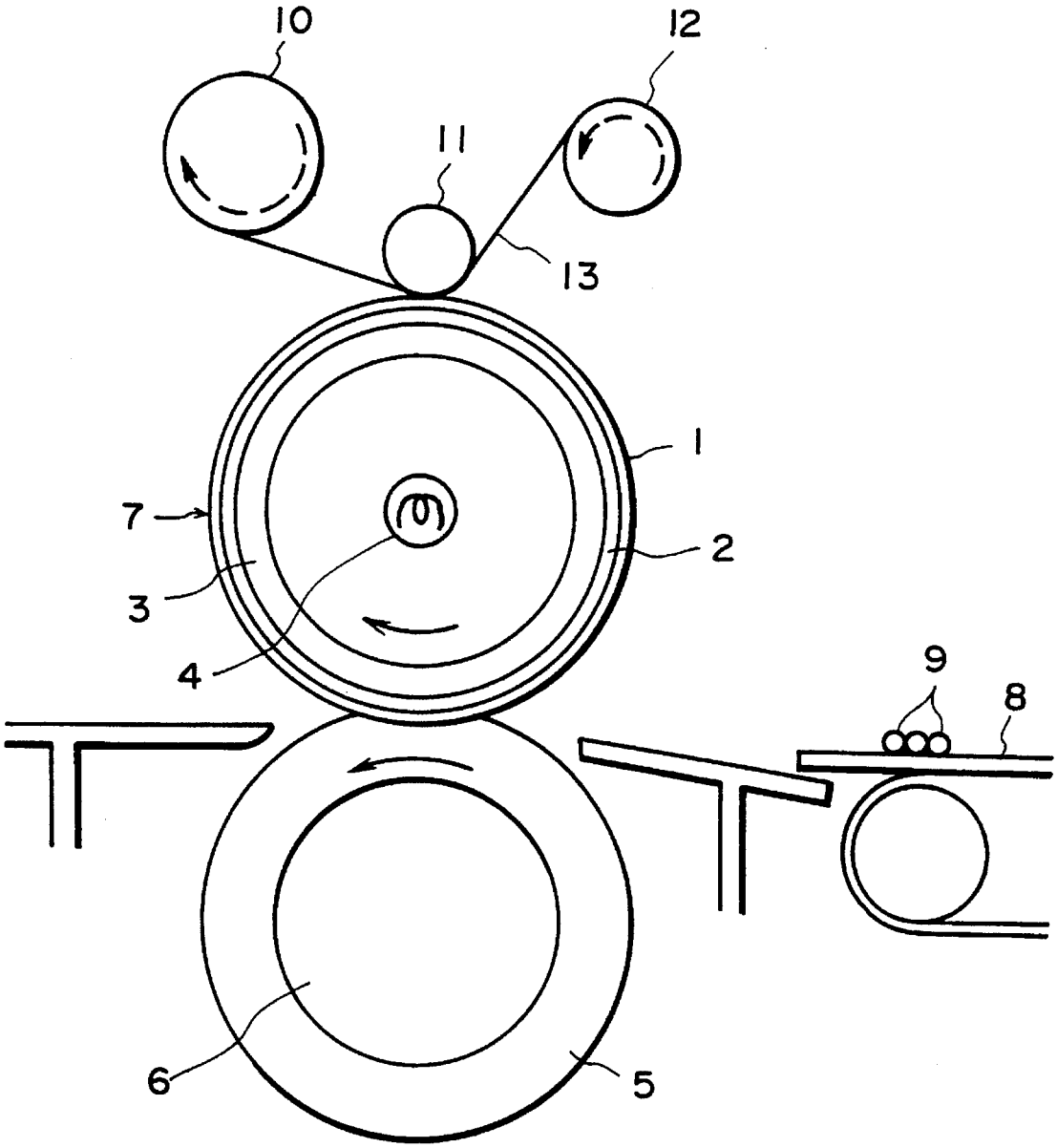
FIG. 1 is a schematic illustration of an apparatus for practicing the fixing method of the present invention.

The Soxhlet extraction residue with THF in the present invention is a polymer or resin component, which cannot be readily extracted with THF or is insoluble in THF, in a toner binder resin and corresponds to an ultra-high molecular weight resin component and a highly crosslinked resin component in the binder resin.

A resin component has a smaller solubility in THF if it has a larger molecular weight. An ultra-high molecular weight resin component is not extracted with THF in a short time and cannot be fully extracted in 6 hours by Soxhlet extraction.

In the Soxhlet extraction, the extract passes through the filter mesh, but an ultra-high molecular weight molecule requires a long time in passing the filter and also hinders passing of another ultra-high molecular weight molecule, so that it causes a delay of extraction.

On the other hand, a highly crosslinked molecule is not readily dissolved due to its steric hindrance and, even if dissolved, takes a long time to pass the filter and also hinders the passing of another molecule. It also fails to pass the filter in some cases.

Further, a highly crosslinked molecule, if it has a high molecular weight, can no longer be dissolved in THF but constitutes a gel content with respect to THF.

Thus, the Soxhlet extraction may be regarded as a measure of mobility of polymer molecules in a solvent. If the content of a resin component having a large mobility is increased, the extraction may be performed in a short time to leave a smaller extraction residue. Reversely, if the content of a resin component having a small mobility is increased, the extraction time becomes long. A resin component having an even smaller mobility cannot be extracted.

The molecular mobility in a solvent can be correlated with a molecular mobility under a thermally molten state. Thus, the magnitude of mobility in a solvent may be regarded as corresponding to the magnitude of mobility in a thermally molten state.

A large mobility in a molten state leads to easy melt-deformation of the toner, thus causing a difficulty in offset prevention. If the mobility is decreased to some extent, the melt-deformation of toner is suppressed so that offset can be prevented but it is difficult to prevent toner flowout from a cleaning member for a fixing roller. By further decreasing the mobility, the toner flowout can be effectively prevented. If the mobility is excessively lowered, the melt-deformation characteristic of the toner is impaired to hinder the toner fixation.

When the 6 hour-extraction residue is 20 wt. % or more, the toner is provided with a mobility capable of preventing the toner flowout from a fixing roller cleaning member.

In case where the 6 hour-extraction residue of a toner is substantially less than 20 wt. %, e.g., less than 1 wt. %, sufficient anti-offset characteristic cannot be attained. When the extraction residue is in the range of from 1.0 wt. % to below 20 wt. %, anti-offset characteristic may be attained but it is difficult to prevent the toner flowout from a fixer cleaning member.

When the extraction residue after 72 hours of extraction is less than 20 wt. %, the toner flowout from a fixer cleaning member can be prevented without impairing the fixability. When the 72 hour-extraction residue as well as the 6 hour-extraction residue is 20 wt. % or more, the toner flowout can be prevented but the toner fixability is also impaired.

In order to satisfy the anti-offset characteristic and the fixability in combination, the 6 hour-extraction residue may will be 20–80 wt. %, preferably 25–70 wt. %, and the 72 hour-extraction residue is less than 15 wt. %.

It is also preferred that the toner binder resin contains more than 5 wt. % of a THF-solution filtering residue as measured in the following manner.

A toner and THF are mixed with each other so as to provide a toner concentration of about 5 mg/ml, and the mixture is left standing for several hours (e.g., about 5–6 hours) at room temperature. Then, the mixture is sufficiently shaken until a lump of the toner disappears and then further left standing for more than 12 hours (e.g., 24 hours). In this instance, a total time from the mixing of the sample with THF to the completion of the standing in THF is taken for at least 24 hours (e.g., 24–30 hours). Thereafter, the mixture is caused to pass through a sample treating filter having a pore size of 0.45–0.5 micron (e.g., "Maishoridisk H-25-5", available from Toso K.K.; and "Ekikurodisk 25CR", available from German Science Japan K.K.) to recover a filtering residue on the filter. It is preferred that the THF-filtering residue thus measured constitutes more than 5 wt. % of the binder resin so as to effectively prevent the toner flowout from the fixer cleaning member.

In case where a large-mobility component giving a good fixability and a small-mobility component giving a good anti-offset characteristic are contained in a good balance, it is possible that the 6 hour-extraction residue is two times the 72 hour-extraction residue or more, whereby it becomes possible to effectively satisfy the fixability and the anti-offset characteristic in combination. In order to provide the toner with an appropriate mobility, it is further preferred that the 6 hour-extraction residue is 2–30 times the 72 hour-extraction residue.

In case where the ratio is below two, the component having a large mobility is liable to be insufficient, thus tending to lower the toner fixability. In case where the ratio exceeds 30, the component having a small mobility is liable to be insufficient, thus tending to provide a somewhat inferior effect of preventing the toner flowout from a fixer cleaning member in some cases.

A resin component extractable in a short time contains a large proportion of a component effective for fixation, and a resin component requiring a long time for extraction contains a large proportion of component effective for preventing offset and the toner flowout.

The residual component is very effective for preventing the toner flowout but can impair the toner fixation if it is contained in a large proportion.

As described above, a resin component extractable in a short time has a low degree of crosslinking or a low molecular weight. A resin component extractable in a long time has a low degree of crosslinking although it may have an ultra-high molecular weight. Further, a non-extractable component is a highly crosslinked component.

A resin component having an ultra-high molecular weight and a relatively low crosslinking degree can provide a toner with a melt characteristic resisting the offset and the toner flowout. It is not advantageous however to provide a toner with an unnecessarily high elasticity to hinder the fixation. The toner binder resin according to the present invention is considered to provide a toner with an elasticity because of entanglement of molecular chains and a little crosslinkage, thus showing a soft elasticity.

Accordingly, the binder resin shows an elasticity necessary for preventing the toner flowout at a high temperature. Further, even at a relatively low temperature, the binder resin retains a soft elasticity and does not hinder the toner deformation, thus providing a good fixability.

It is very difficult to obtain such a resin composition having an ultra-high molecular weight and a relatively low crosslinking degree only by polymerization. If it is tried to obtain such a component only through polymerization, a highly crosslinked component is produced.

A highly crosslinked component has an unnecessarily high elasticity than is required of resisting the toner flowout. Thus, such a highly crosslinked component is considered to show a hard elasticity and shows a strong elasticity at a relatively low temperature, thus hindering the toner deformation to cause problems with fixation.

The toner binder resin according to the present invention is characterized in that a high molecular weight component therein shows a mobility which does not substantially change with time when held at a high temperature. This is represented by a factor that the toner has a dynamic modulus and a loss modulus as measured at 200° C. and 0.1 Hz which are substantially unchanging with time, more specifically that the modulis measured after holding at 200° C. are below two times, preferably 0.5 to below 2 times, further preferably 0.8–1.8 times, those before the holding.

The mobility change with time of the toner binder resin attached to the fixer cleaning member leads to the following difficulties. If the change rate exceeds 2, the toner material attached to the fixer cleaning member or a thermistor contacting the fixing roller is caused to have an excessively high viscoelasticity and a small mobility and is very rigid, thus damaging the fixing roller or hindering effective cleaning of the fixing roller.

On the other hand, if the change rate is below 0.5, the viscoelasticity is excessively lost and results in a toner material having a large mobility and being soft, thus tending to cause image staining due to toner flowout from the fixer cleaning member.

It is preferred that the toner shows a dynamic modulus of $1\times10^3$–$1\times10^5$ dyn/cm$^2$ and a loss modulus of $1\times10^2$–$5\times10^4$ dyn/cm$^2$ and the dynamic modulus is larger than the loss modulus, so that the toner shows a desirable viscoelasticity without causing toner offset and the toner material attached to the fixer cleaning member shows the best preferred viscoelasticity preventing the toner flowout from the fixer cleaning member.

In case where a toner has a dynamic modulus of below $1\times10^3$ dyn/cm$^2$ or a loss modulus of below $1\times10^2$ dyn/cm$^2$, or the dynamic modulus is smaller than the loss modulus, the toner material accumulated on the fixer cleaning member tends to cause the toner flowout.

In case where the toner has a dynamic modulus exceeding $1\times10^5$ dyn/cm$^2$ and a loss modulus exceeding $5\times10^4$ dyn/cm$^2$, the fixation characteristic is adversely affected.

The characteristic resin component constituting the binder resin used in the present invention may for example be prepared in the following manner.

A polymer having a functional group, such as a carboxyl group or hydroxyl group, and comprising a crosslinked high-molecular weight component is melt-kneaded together with a compound, e.g., a metal containing compound, reactive with the functional group of the polymer under the action of a shearing force. At this time, the crosslinked high-molecular weight component of the polymer is severed and re-crosslinked to obtain an ultra-high-molecular weight resin component. Further, the mobility of the toner can be moderated by appropriately utilizing the entanglement of polymer chains in the molten state, crosslinkage, and interactions between functional groups and between a functional group and a polar group in the internal additives.

It is possible to effect the above process during toner production. For this purpose, the above-mentioned polymer and the compound may be melt-kneaded together with other additives such as another resin,a magnetic material and a colorant.

The extraction residue according to Soxhlet extraction referred to herein may be measured in the following manner.

About 0.5 g of a resinous sample is weighed and placed in a cylindrical filter paper (e.g., "No. 86R" having a size of 28 mm-dia.×100 mm-H, available from Toyo Roshi K.K.) and then subjected to extraction with 200 ml of solvent THF (tetrahydrofuran) in a Soxhlet's extractor. The extraction is performed for 6 hours and 72 hours separately. At this time, the reflux rate is controlled so that each THF extraction cycle takes about 4–5 minutes. After the extraction, the cylindrical filter paper is taken out and sufficiently dried to weigh the extraction residue. The extraction residue content (wt. %) may be calculated as: $(W_2/W_1)\times100$, wherein $W_1$ denotes the weight of the resin content in the original sample, and $W_2$ denotes the weight of the resin content in the extraction residue. For example, in case where the resinous sample is a magnetic toner, the weight $W_1$ is obtained by subtracting the weight of the THF-insoluble content such as the magnetic material and the pigment from the total sample toner weight, and the weight $W_2$ is obtained by subtracting the weight of the THF-insoluble content such as the magnetic material and the pigment from the weight of the extraction residue.

Figure 2:
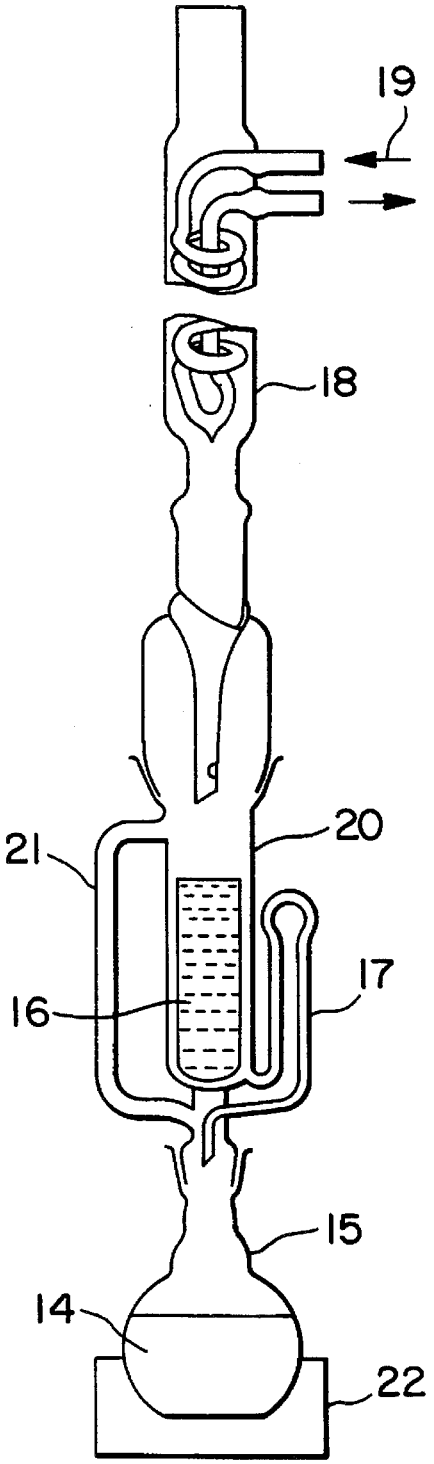
FIG. 2 is an illustration of a Soxhlet extractor for practicing the Soxhlet extraction.

An example of the Soxhlet extractor is shown in FIG. 2. In operation, THF 14 contained in a vessel 15 is vaporized under heating by a heater 22, rand the vaporized THF is caused to pass through a pipe 21 and guided to a cooler 18 which is always cooled with cooling water 19. The THF cooled in the cooler 18 is liquefied and stored in a reservoir part containing a cylindrical filter paper 16. Then, when the level of THF exceeds that in a middle pipe 17, the THF is discharged from the reservoir 16, the THF is discharged from the reservoir part to the vessel 15 through the pipe 17. During the operation, the toner or resin in the cylindrical filter paper is subjected to extraction with the thus circulating THF.

Crosslinking with a metal has been proposed heretofore. A principal component of a binder resin of a toner generally has a molecular weight of at most about $10^5$. Crosslinking of a resin component having such a molecular weight does not provide a characteristic resin component contained in the toner according to the present invention. A toner using such a crosslinked resin component may show an anti-offset characteristic but cannot show an effect of preventing toner flowout from the fixer cleaning member or results in a noticeable change with time.

The binder resin used in the present invention may preferably comprise a vinyl polymer, a polyester or a graft-copolymer of an unsaturated polyester and a vinyl monomer which contains a high molecular weight component having a molecular weight exceeding $10^5$ and/or a crosslinked high molecular weight component, has an acid value and has been obtained through a process such as bulk polymerization, solution polymerization, emulsion polymerization, block copolymerization or graft copolymerization.

It is also preferred that the crosslinked high-molecular weight component comprises a polymer containing a component insoluble in a solvent (i.e., a gel content). The gel content may preferably be contained in a proportion of 10–60 wt. %. The gel content may also be measured according to the above-described Soxhlet extraction method as a 6 hour-extraction residue since the gel content shows little change with time of extraction.

Among the above-described polymers, a vinyl polymer is particularly preferred because of a moderate reactivity. A polyester-type polymer having a low degree of crosslinkage can cause a vigorous reaction and is liable to cause a relatively fast reaction even on the fixer cleaning member to have increased crosslinkage and hardness, thus resulting in damage of the fixing roller or failure in cleaning function of the fixing roller cleaning member.

It is also possible to mix the above polymer or polymer composition with another vinyl polymer, polyester, polyurethane, epoxy resin, polyvinyl butyral, rosin, modified rosin, terpene resin, phenolic resin, aliphatic or alicyclic hydrocarbon resin, aromatic petroleum resin, halo-paraffin and paraffin wax.

In case where the binder resin constituting the toner according to the present invention comprises a vinyl polymer, a vinyl copolymer or a mixture of these, examples of the vinyl monomer providing the binder resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tertbutylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate; 2-chloroethyl acrylate; and phenyl acrylate; vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; the esters of the above-mentioned α,β-unsaturated acids and the diesters of the above-mentioned dibasic acids. These vinyl monomers may be used singly or in combination of two or more species.

Among these, a combination of monomers providing styrene-type copolymers and styrene-acrylic type copolymers may be particularly preferred.

It is possible to provide the vinyl polymer used in the present invention with an acid value by incorporating therein a monomer having an acid group, examples of which may include: unsaturated dibasic acids, such as maleic acid, citraconic acid, itaconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; half esters of unsaturated dibasic acids, such as monomethyl maleate, monoethyl maleate, monobutyl maleate, monomethyl citraconate, monoethyl citraconate, monobutyl citraconate, monomethyl itaconate, monomethyl alkenylsuccinate, monomethyl fumarate, and monomethyl mesaconate; and unsaturated dibasic acid esters, such as dimethyl maleate and dimethyl fumarate. Further, there may also be used: α,β-unsaturated acids, such as acrylic acid, methacrylic acid, crotonic acid, and cinnamic acid; α,β-unsaturated acid anhydrides, such as crotonic anhydride and cinnamic anhydride; anhydrides between such α,β-unsaturated acids and lower fatty acids; alkenylmalonic acid, alkenylglutaric acid, alkenyladipic acid, and anhydrides and monoesters of these acids.

Among the above, it is particularly preferred to use monoesters of α,β-unsaturated dibasic acids, such as maleic acid, fumaric acid and succinic acid as a monomer for providing the binder resin used in the present invention. Specific examples of the monoesters may include: monomethyl maleate, monoethyl maleate, monobutyl maleate, monooctyl maleate, monoallyl maleate, monophenyl maleate, monomethyl fumarate, monoethyl fumarate, monobutyl fumarate, monophenyl fumarate, monobutyl n-butenylsuccinate, monomethyl n-octenylsuccinate, monoethyl n-butenylmalonate, monomethyl n-dodecynylglutarate, and monobutyl n-butenyladipate.

The crosslinking monomer may principally be a monomer having two or more polymerizable double bonds.

The binder resin used in the present invention may preferably include a crosslinking structure obtained by using a crosslinking monomer, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of about 0.01–5 wt. parts, particularly about 0.03–3 wt. parts, per 100 wt. parts of the other vinyl monomer components.

Among the above-mentioned crosslinking monomers, aromatic divinyl compounds (particularly, divinylbenzene) and diacrylate compounds connected with a chain including an aromatic group and an ether bond may suitably be used in a toner resin in view of fixing characteristic and anti-offset characteristic.

It is preferred that the binder resin has an acid value (as measured according to JIS K-0070) of at most 100 mgKOH/g. In case where the binder resin mainly comprises a vinyl polymer, the acid value may preferably be 2–70 mgKOH/g, further preferably 5–60 mgKOH/g. If the acid value is below 2 mg/KOH, the re-crosslinking does not sufficiently occur.

In case where the binder resin mainly comprises a polyester-type polymer, it is preferred that the acid value is at most 100 mgKOH/g, particularly at most 50 mgKOH/g. When the acid value exceeds 100 mgKOH/g, the chargeability of the toner is liable to be affected by environmental conditions, and thus the developing performance is affected by a change in environmental conditions.

The polyester resin used in the present invention may be constituted as follows.

Examples of the dihydric alcohol may include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (A):

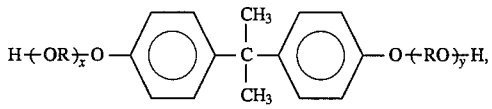

(A)

wherein R' denotes an ethylene or propylene group, x and y are independently 0 or a positive integer with the proviso that the average of x+y is in the range of 0–10; and diols represented by the following formula (B):

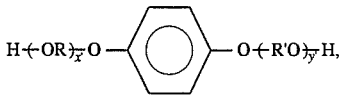

(B)

wherein R' denotes $-CH_2CH_2-$,

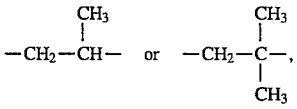

x' and y' are independently 0 or a positive integer with the proviso that the average of x'+y' is in the range of 0–10.

Examples of the dibasic acid may include dicarboxylic acids and derivatives thereof including: benzenedicarboxylic acids, such as phthalic acid, terephthalic acid and isophthalic acid, and their anhydrides or lower alkyl esters;

alkyldicarboxylic acids, such as succinic acid, adipic acid, sebacic acid and azelaic acid, and their anhydrides and lower alkyl esters; alkenyl- or alkylsuccinic acid, such as n-dodecenylsuccinic acid and n-dodecyl acid, and their anhydrides and lower alkyl esters; and unsaturated dicarboxylic acids, such as fumaric acid, maleic acid, citraconic acid and itaconic acid, and their anhydrides and lower alkyl esters.

It is preferred to also use polyhydric alcohols having three or more functional groups and polybasic acids having three or more acid groups.

Examples of such polyhydric alcohol having three or more hydroxyl groups may include: sorbitol, 1,2,3,6-hexanetetrol, 1,4-sorbitane, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxybenzene.

Examples of polybasic carboxylic acids having three or more functional groups may include polycarboxylic acids and derivatives thereof including: trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butane tricarboxylic acid, 1,2,5-hexanetricarboxylic acid, 1,3-dicarboxyl-2-methyl-2-methylenecarboxypropane, tetra(methylenecarboxyl-)methane, 1,2,7,8-octanetetracarboxylic acid, Empol trimer acid, and their anhydrides and lower alkyl esters; and tetracaboxylic acids represented by the formula:

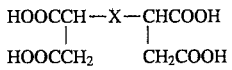

(X denotes a $C_5$ to $C_{30}$-alkylene group or alkenylene group having at least one side chain having at least three carbon atoms), and their anhydrides and lower alkyl esters.

The polyester resin used in the present invention may preferably be constituted from 40–60 mol. %, more preferably 45–55 mol. %, of the alcohol component and 60–40 mol. %, more preferably 55–45 mol. %, of the acid component respectively based on the total of the alcohol and acid components. Further, the total of the polyhydric alcohol and the polybasic acid each having three or more functional groups may preferably constitute 5–60 mol. % of the total alcohol and acid components constituting the polyester resin.

The method of the JIS acid value measurement is explained hereinbelow.

2–10 g of a sample resin is weighed and placed in a 200 to 300 ml-Erlenmeyer flask, and an ethanol/benzene (=½) mixture is added thereto to dissolve the resin. If the resin is not readily dissolved, a small amount of acetone may be added. The resultant solution is titrated with a preliminarily standardized N/10 KOH/alcohol solution with phenolphthalein as the indicator. The acid value is calculated from the consumption of the KOH/alcohol solution based on the following equation:

Acid value=vol (ml) of KOH/alcohol×N×56.1/sample weight, wherein N denotes the factor of the N/10 KOH/alcohol solution.

The metal-containing compound reactive with the resin component in the present invention may be those containing metal ions as follows: divalent metal ions, such as $Ba^{2+}$, $Mg^{2+}$, $Ca^{2+}$, $Hg^{2+}$, $Sn^{2+}$, $Pb^{2+}$, $Fe^{2+}Co^{2+}$, $Ni^{2+}$ and $Zn^{2+}$; and trivalent ions, such as $Al^{3+}$. $Sc^{3+}$, $Fe^{3+}$, $Ce^{3+}$, $Ni^{3+}$, $Cr^{3+}$ and $Y^{3+}$.

Among the above metal compounds, organic metal compounds provide excellent results because they are rich in compatibility with or dispersibility in a polymer and cause a crosslinking reaction uniformly in the polymer or copolymer.

Among the organic metal compounds, organic metal complexes or organic metal salts containing an organic compound, which is rich in vaporizability or sublimability, as a ligand or a counter ion, are advantageously used. Among the organic compounds forming coordinate bonds or ion pairs with metal ions, examples of those having the above property may include: salicylic acid and its derivatives, such as salicylic acid, salicylamide, salicylamine, salicylaldehyde, salicylosalicylic acid, and di-tertbutylsalicylic acid; β-diketones, such as acetylacetone and propionylacetone; and low-molecular weight carboxylic acid salts, such as acetate and propionate.

In case where the organic metal complex is a metal complex, it can also function as a charge control agent for toner particles. Examples of such a metal complex include azo metal complexes represented by the following formula [I]:

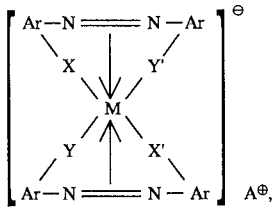

[I]

wherein M denotes a coordination center metal, inclusive of metal elements having a coordination number of 6, such as Sc, Ti, V, Cr, Co, Ni Mn and Fe; Ar denotes an aryl group, such as phenyl or naphthyl, capable of having a substituent, examples of which may include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms); and $A^{\oplus}$ denotes hydrogen, sodium, potassium, ammonium or aliphatic ammonium.

Specific examples of this type of complexes may include the following:

Complex [I]-1

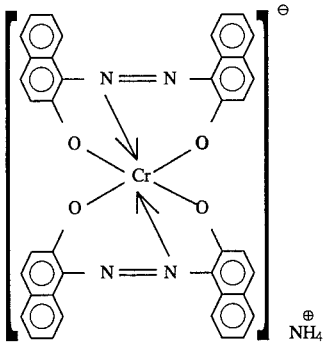

-continued

Complex [I]-2

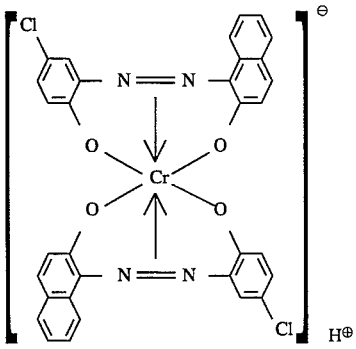

Complex [I]-3

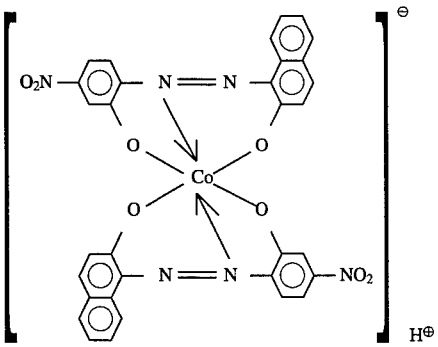

Complex [I]-4

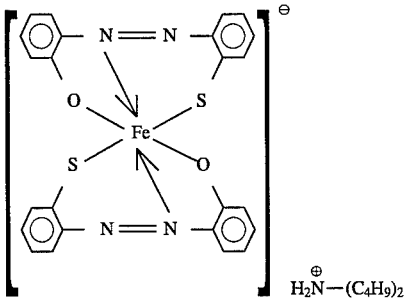

Complex [I]-5

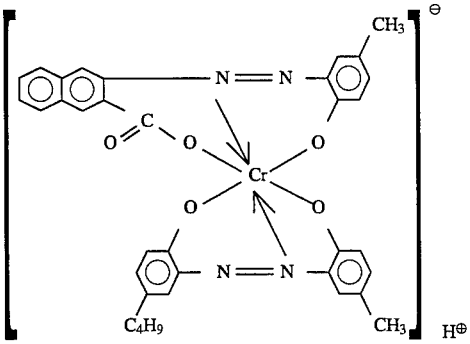

-continued

Complex [I]-6

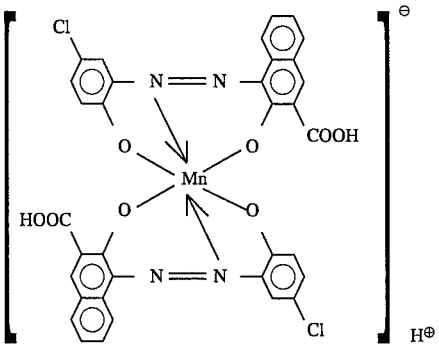

Organic metal complexes represented by the following formula [II] impart a negative chargeability and may be used as the organic metal compound in the present invention.

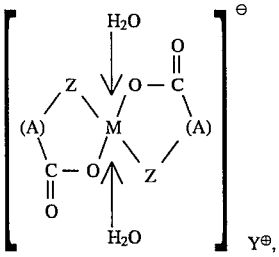

[II]

wherein M denotes a coordination center metal, inclusive of metal elements having a coordination number of 6, such as Cr, Co, Ni Mn and Fe; A denotes

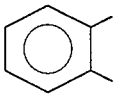

(capable of having a substituent, such as an alkyl),

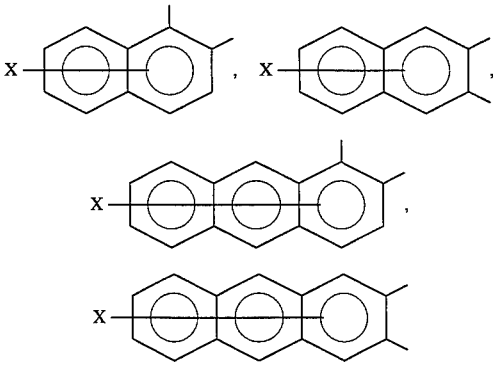

(X denotes hydrogen alkyl, halogen, or nitro),

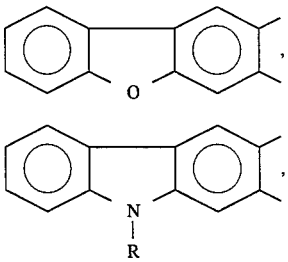

-continued

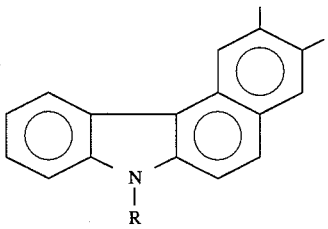

(R denotes hydrogen, $C_1$–$C_{18}$ alkyl or $C_1$–$C_{18}$ alkenyl); $Y^{\oplus}$ denotes a counter ion, such as hydrogen, sodium, potassium, ammonium, or aliphatic ammonium; and Z denotes —O— or —CO•O—.

The above organic metal compounds may be used singly or in combination of two or more species.

The addition amount of the organic metal compounds to the toner particles may be varied depending on the specific binder resin used, the use or nonuse of a carrier, the colorant for the toner and the reactivity of the metal compounds with the resin but may generally be 0.01–20 wt. %, preferably 0.1–10 wt. %, more preferably 1–5 wt. %, of the binder resin including the non-reacted portion thereof.

The above-mentioned organic metal complex or organic metal salt shows excellent compatibility and dispersibility to provide a toner with a stable chargeability, particularly when it is reacted with the binder resin at the time of melt-kneading.

As described above, the organic metal complex or organic metal salt as a crosslinking component can be also used as a charge control agent, but it is also possible to use another charge control agent, as desired, in combination. Such another charge control agent may for example be a known negative or positive charge control agent.

Examples of such known negative charge control agents may include: organic metal complexes and chelate compounds inclusive of monoazo metal complexes as described above, acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols.

Examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologs inclusive of phosphonium salts, and lake pigments thereof; triphenylmethane dyes and lake pigments thereof (the laking agents including, e.g., phosphotungstic acid, phosphomolybdic acid, phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; and diorganotin borates, such as dibutyltin borate, dioctyltin borate and dicyclohexyltin borate. These may be used singly or in mixture of two or more species. Among these, nigrosine compounds and tetraammonium salts are particularly preferred.

It is preferred to use the toner according to the present invention together with silica fine powder blended therewith in order to improve the charge stability, developing characteristic and fluidity.

The silica fine powder used in the present invention provides good results if it has a specific surface area of 30 $m^2/g$ or larger, preferably 50–400 $m^2/g$, as measured by nitrogen adsorption according to the BET method. The silica fine powder may be added in a proportion of 0.01–8 wt. parts, preferably 0.1–5 wt. parts, per 100 wt. parts of the toner.

For the purpose of being provided with hydrophobicity and/or controlled chargeability, the silica fine powder may well have been treated with a treating agent, such as silicone varnish, modified silicone varnish, silicone oil, modified silicone oil, silane coupling agent, silane coupling agent having functional group or other organic silicon compounds. It is also preferred to use two or more treating agents in combination.

Other additives may be added as desired, inclusive of: a lubricant, such as polytetrafluoroethylene, zinc stearate or polyvinylidene fluoride, of which polyvinylidene fluoride is preferred; an abrasive, such as cerium oxide, silicon carbide or strontium titanate, of which strontium titanate is preferred; a flowability-imparting agent, such as titanium oxide or aluminum oxide, of which a hydrophobic one is preferred; an anti-caking agent, and an electroconductivity-imparting agent, such as carbon black, zinc oxide, antimony oxide, or tin oxide. It is also possible to use a small amount of white or black fine particles having a polarity opposite to that of the toner as a development characteristic improver.

It is also preferred to add 0.5–5 wt. % of a waxy substance, such as low-molecular weight polyethylene, low-molecular weight polypropylene, low-molecular weight propylene-ethylene copolymer, microcrystalline wax, carnauba wax, sasol wax or paraffin wax, to the toner for the purpose of improving the releasability of the toner at the time of hot roller fixation.

The toner according to the present invention can be mixed with carrier powder to be used as a two-component developer. In this instance, the toner and the carrier powder may be mixed with each other so as to provide a toner concentration of 0.1–50 wt. %, preferably 0.5–10 wt. %, further preferably 3–5 wt. %

The carrier used for this purpose may be a known one, examples of which may include: powder having magnetism, such as iron powder, ferrite powder, and nickel powder and carriers obtained by coating these powders with a resin, such as a fluorine-containing resin, a vinyl resin or a silicone resin.

The toner according to the present invention can be constituted as a magnetic toner containing a magnetic material in its particles. In this case, the magnetic material can also function as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of 0.1–2 micron, preferably 0.1–0.5 micron.

The magnetic material may preferably show magnetic properties under application of 10 kilo-Oersted, inclusive of: a coercive force of 20–30 Oersted, a saturation magnetization of 50–200 emu/g, and a residual magnetization of 2–20 emu/g. The magnetic material may be contained in the toner in a proportion of 20–200 wt. parts, preferably 40–150 wt. parts, per 100 wt. parts of the resin component.

The toner according to the present invention can contain a colorant which may be an appropriate pigment or dye.

Examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. These pigments are used in an amount sufficient to provide a required optical density of the fixed images, and may be added in a proportion of 0.1–20 wt. parts, preferably 2–10 wt. parts, per 100 wt. parts of the binder resin.

Examples of the dye may include: azo dyes, anthraquinone dyes, xanthene dyes, and methine dyes, which may be added in a proportion of 0.1–20 wt. parts, preferably 0.3–10 wt. parts, per 100 wt. parts of the binder resin.

The toner according to the present invention may be prepared through a process including: sufficiently blending the binder resin, the organic metal compound such as the metal salt or metal complex, a colorant, such as pigment, dye and/or a magnetic material, and an optional charge control agent and other additives, as desired, by means of a blender such as a Henschel mixer or a ball mill, melting and kneading the blend by means of hot kneading means, such as hot rollers, a kneader or an extruder to cause melting of the resinous materials and disperse or dissolve the magnetic material, pigment or dye therein, and cooling and solidifying the kneaded product, followed by pulverization and classification.

The thus obtained toner may be further blended with other external additives, as desired, sufficiently by means of a mixer such as a Henschel mixer to provide a developer for developing electrostatic images.

In the melt-kneading step for producing the toner of the present invention, it is effective to perform the kneading in a low temperature melting state so as to apply a high shearing force to the molten polymer to sever the highly crosslinked high molecular weight component and then cause re-crosslinking with a metal-containing compound to form an ultra-highmolecular weight component.

An embodiment of the fixing method according to the present invention will now be described with reference to FIG. 1.

In a fixing apparatus shown in FIG. 1, a yet-unfixed image composed of a toner 9 is fixed onto a toner-receiving sheet 8 while the sheet 8 carrying the toner image 9 is passed between a fixing roller 7 and a pressing roller 6 having a surface elastic layer 5 and pressed against the fixing roller 7 with an appropriate nip. The fixing roller 7 contains a heat-generating source 4 such as a halogen heater inside thereof and comprises a coating resin layer 1 as the uppermost layer on a core metal 3 by the medium of a primer layer 2. The coating resin layer 1 comprises a film or tube of, e.g., a silicone rubber or a fluorine-containing resin. Preferred examples of the fluorine-containing resin may include: tetrafluoroethylene-perfluoroalkyl vinyl ether copolymer, polytetrafluoroethylene (PTFE) and hexafluoropropylene-tetrafluoroethylene copolymer. A cleaning member comprising a web 13 impregnated with a release agent, such as silicon oil, is used to apply the release agent onto the fixing roller 7 and remove the toner attached to the fixing roller 7 to clean the fixing roller surface.

The web 13 of the cleaning member is gradually fed from a feed roller 12, pressed against the fixing roller 7 by a pressing member 11 and then wound up about a wind-up roller 10. When the heat-melting properties of the toner are inadequate, the toner material standing on a part of the web 13 abutted to the fixing roller 7 is caused to flow out by heat applied from the fixing roller 7 to stain the fixing roller surface.

The cleaning member can also be suitably constituted as one including a cleaning pad or a cleaning roller in addition to the one using a cleaning web as described above. The cleaning web, cleaning pad or cleaning roller can be impregnated with a release agent as described above, or such impregnation can be omitted.

The fixing roller surface temperature may preferably be 150°–250° C., more preferably be 150°–230° C. The pressing roller 6 may preferably be pressed against the fixing roller 7 so as to exert an abutting pressure of at least 1 kg/cm$^2$.

Hereinbelow, the present invention will be described in more detail based on Examples. First of all, Synthesis Examples of binder resins for use in toners are explained, in which the glass transition temperatures (Tg) of the resins were measured by using a differential scanning calorimeter (DSC) ("DSC-7", available from Perkin-Elmer Co.) in the following manner.

A sample resin in an amount of 5–20 mg, preferably about 10 mg, is accurately weighed and placed in an aluminum pan (an empty pan being used as a reference). The measurement is performed in a normal temperature - normal humidity environment at a temperature raising rate of 10° C./min within a temperature range of 30° C. to 200° C. A heat absorption main peak is generally found in the range of 40°–100° C.

Based on the heat absorption curve, a first base line is drawn before an initial slope leading to the main peak and a second base line is drawn after a final slope descending from the main peak. A medium line is drawn substantially in parallel with and with equal distances from the first and second base lines, whereby the medium line and the heat absorption curve form an intersection with each other. The temperature at the intersection is taken as the glass transition temperature (Tg °C.).

The values of Tg thus measured, JIS acid values and 6 hour-extraction residues for the binder resins obtained in Synthesis Examples are summarized in Table 1 appearing after Synthesis Examples.

Synthesis Example 1

| | |
|---|---|
| Styrene | 66.20 wt. part(s) |
| α-Methylstyrene | 6.00 wt. part(s) |
| n-Butyl acrylate | 23.00 wt. part(s) |
| Mono-n-butyl maleate | 4.00 wt. part(s) |
| Divinylbenzene | 0.80 wt. part(s) |
| Benzoyl peroxide | 3.00 wt. part(s) |

Into a mixture of the above ingredients, 170 wt. parts of water containing 0.12 wt. part of partially saponified polyvinyl alcohol was added, and the resultant mixture was vigorously stirred to form a suspension liquid. Into a reaction vessel containing 50 wt. parts of water and purged with nitrogen, the above suspension liquid was charged and subjected to 8 hours of suspension polymerization at 80° C. After the completion of the reaction, the product was washed with water, de-watered and dried to obtain a resin A. The resin A showed a JIS acid value, a 6 hour-extraction residue and a glass transition temperature (Tg) as shown in Table 1 appearing hereinafter.

Synthesis Example 2

| | |
|---|---|
| Styrene | 67.15 wt. part(s) |
| α-Methylstyrene | 6.00 wt. part(s) |
| n-Butyl acrylate | 23.00 wt. part(s) |
| Mono-n-octyl maleate | 2.85 wt. part(s) |

-continued

| | |
|---|---|
| Ethylene dimethacrylate | 1.00 wt. part(s) |
| Benzoyl peroxide | 3.00 wt. part(s) |

A resin B was prepared from the above ingredients otherwise in the same manner as in Synthesis Example 1.

Synthesis Example 3

| | |
|---|---|
| Styrene | 66.65 wt. part(s) |
| n-Butyl acrylate | 28.00 wt. part(s) |
| Mono-n-butyl maleate | 5.00 wt. part(s) |
| Divinylbenzene | 0.35 wt. part(s) |
| Benzoyl peroxide | 1.50 wt. part(s) |
| Di-tert-butyl peroxy-2-ethyl-hexanoate | 0.50 wt. part(s) |

A resin C was prepared from the above ingredients otherwise in the same manner as in Synthesis Example 1.

Synthesis Example 4

| | |
|---|---|
| Styrene | 68.75 wt. part(s) |
| n-Butyl acrylate | 28.00 wt. part(s) |
| Acrylic acid | 3.00 wt. part(s) |
| Divinylbenzene | 0.25 wt. part(s) |
| Di-tert-butyl peroxy-2-ethylhexanoate | 3.00 wt. part(s) |

A resin D was prepared from the above ingredients otherwise in the same manner as in Synthesis Example 1.

Synthesis Example 5

| | |
|---|---|
| Styrene | 67.75 wt. part(s) |
| n-Butyl acrylate | 23.00 wt. part(s) |
| Mono-n-butyl maleate | 8.00 wt. part(s) |
| Divinylbenzene | 1.25 wt. part(s) |
| Di-tert-butyl peroxide | 0.60 wt. part(s) |

A mixture of the above ingredients was added dropwise in 4 hours to 200 weight parts of xylene under heating. The polymerization was further completed under xylene refluxing, followed by removal of the xylene under a reduced pressure and an elevated temperature (200° C.) to prepare a resin E.

The properties of the resins A–E prepared in the above Synthesis Examples are inclusively shown in the following Table 1.

TABLE 1

| | Properties of resins | | |
|---|---|---|---|
| Resin | JIS acid value (mg KOH/g) | 6 Hr-extraction residue (%) | Tg (°C.) |
| A | 8.5 | 32.1 | 59 |
| B | 7.1 | 25.6 | 59 |
| C | 16.3 | 41.3 | 58 |
| D | 23.2 | 29.8 | 59 |
| E | 25.9 | 0.0 | 58 |

Example 1

| | |
|---|---|
| Resin A | 100 wt. parts |
| Magnetic iron oxide | 60 wt. parts |
| Di-tert-butylsalicylic acid Cr complex | 2 wt. parts |
| Low-molecular weight ethylene-propylene copolymer | 3 wt. parts |

The above ingredients were preliminarily blended and melt-kneaded through a twin-screw extruder set at 110° C. and having a kneading zone incorporating a backward screw. The kneaded product was cooled, coarsely crushed, finely pulverized by means of a pulverizer using jet air stream and classified by a wind-force classifier to obtain a magnetic toner having a weight-average particle size of 11 microns. The dynamic visco-elasticity characteristics under sinewave vibration (frequency: 0.1 Hz) of the magnetic toner were measured at 200° C. by means of a rheometer ("IR200", available from Iwamoto Seisakusho K.K.) remodeled so that the measurement could be performed between parallel plates of 30 mm in diameter and with a gap of about 1 mm therebetween.

The extraction-residue resin component and viscoelastic characteristics of the magnetic toner are shown in Table 2.

100 wt. parts of the above magnetic toner and 0.4 wt. part of hydrophobic colloidal silica were blended with each other to form a developer.

The developer was evaluated by an electrophotographic copier ("NP-8580", mfd. by Canon K.K.) equipped with a fixing apparatus as shown in FIG. 1 with respect to fixability and the effect of preventing toner flowout from the cleaning member for the fixing roller. The surface temperature of the fixing roller was controlled so that the upper limit temperature was about 200° C. The fixing speed was about 484 mm/sec. The cleaning member was composed of a web of nonwoven cloth impregnated with silicone oil, and the web was moved at a rate of 0.1 mm per fixation of one A3-size sheet.

The fixability was evaluated in the following manner. The test apparatus was placed in an environment of low temperature-low humidity (15° C., 10%) overnight so as to fully adapt the test apparatus and the fixing device therein and then making continuously 200 sheets of copied images. The surface temperature of the fixing roller was 195° C. initially and 155° C. at the time of copying the 200-th sheet. The copied image on the 200-th sheet was used for evaluation of the fixability by rubbing the image with a lens cleaning paper ("Dusper" (trade name), mfd. by OZU Paper Co. Ltd.) for 10 reciprocations under a weight of about 100 g. Then, the degree of peeling of the toner image was evaluated in terms of a decrease (%) in reflection density. The anti-offset characteristic was evaluated by taking continuously 200 sheets of copied images, then taking intermittently sheets of copied images for 3 minutes at intervals of 30 seconds per sheet, and then observing whether images were stained or not. Further, the degree of staining of the cleaning web incorporated in the fixing device was evaluated.

As a result, the toner showed a good storability in terms of dischargeability, a good fixability without causing offset and no re-flowout of the toner material from the cleaning web in the fixing device.

Then, the cleaning web was stopped, and an intermittent copying test was performed at an intermittent copying rate of one A4-size sheet/7 sec instead of a normal continuous copying rate of 80 A4-size sheets/min to evaluate the staining on the fixing roller by observing fixed images. As a result, no stain appeared in fixed images even at the time of copying of 10,000 sheets, and no damage was observed on the fixing roller. The evaluation results are summarized in Table 3.

Example 2

| | |
|---|---|
| Resin B | 100 wt. parts |
| Magnetic iron oxide | 60 wt. parts |
| tert-Butylhydroxynaphthoic acid Cr complex | 2 wt. parts |
| Low-molecular weight ethylene-propylene copolymer | 3 wt. parts |

A magnetic toner was prepared from the above ingredients otherwise in the same manner as in Example 1 and evaluated in the same manner as in Example 1. The properties and evaluation results of the toner are shown in Tables 2 and 3, respectively.

Example 3

| | |
|---|---|
| Resin C | 100 wt. parts |
| Magnetic iron oxide | 60 wt. parts |
| Di-tert-butylsalicylic acid Cr complex | 2 wt. parts |
| Low-molecular weight ethylene-propylene copolymer | 3 wt. parts |

A magnetic toner was prepared from the above ingredients otherwise in the same manner as in Example 1 and evaluated in the same manner as in Example 1. The properties and evaluation results of the toner are shown in Tables 2 and 3, respectively.

Example 4

| | |
|---|---|
| Resin D | 100 wt. parts |
| Magnetic iron oxide | 60 wt. parts |
| Monoazo Cr complex | 2 wt. parts |
| Low-molecular weight ethylene-propylene copolymer | 3 wt. parts |

A magnetic toner was prepared from the above ingredients otherwise in the same manner as in Example 1 and evaluated in the same manner as in Example 1. The properties and evaluation results of the toner are shown in Tables 2 and 3, respectively.

Comparative Example 1

| | |
|---|---|
| Resin A | 100 wt. parts |
| Magnetic iron oxide | 60 wt. parts |
| Low-molecular weight ethylene-propylene copolymer | 3 wt. parts |

A magnetic toner was prepared from the above ingredients otherwise in the same manner as in Example 1 and evaluated in the same manner as in Example 1. The properties and evaluation results of the toner are shown in Tables 2 and 3, respectively.

The highly crosslinked component was severed but no-recrosslinking was caused, so that all the resin component was extracted in 6 hours. In the test, images were stained due to toner flowout.

Comparative Example 2

| | |
|---|---|
| Resin C | 100 wt. parts |
| Magnetic iron oxide | 60 wt. parts |
| Monozo Cr complex | 1 wt. parts |
| Di-tert-butylsalicylic acid Cr complex | 1 wt. parts |
| Low-molecular weight ethylene-propylene copolymer | 3 wt. parts |

The above ingredients were preliminarily blended and melt-kneaded through a twin-screw extruder set at 150° C. having a kneading zone incorporating only a forward screw. The kneaded product was cooled, coarsely crushed, finely pulverized by means of a pulverizer using jet air stream and classified by a wind-force classifier to obtain a magnetic toner having a weight-average particle size of 11 microns.

100 wt. parts of the above magnetic toner and 0.4 wt. part of hydrophobic colloidal silica were blended with each other to form a developer, which was then evaluated in the same manner as in Example 1. The properties and evaluation results of the toner are shown in Tables 2 and 3, respectively. Re-crosslinking was effected, while the severance of the highly crosslinked component was insufficient, to result in a highly crosslinked high-molecular weight component. As a result, the fixability was deteriorated and the fixing roller began to be damaged.

Comparative Example 3

| | |
|---|---|
| Resin E | 100 wt. parts |
| Magnetic iron oxide | 60 wt. parts |
| Monoazo Cr Complex | 1 wt. parts |
| Di-tert-butylsalicylic acid Cr complex | 2 wt. parts |
| Low-molecular weight ethylene-propylene copolymer | 3 wt. parts |

A magnetic toner was prepared from the above ingredients otherwise in the same manner as in Example 1 and evaluated in the same manner as in Example 1. The properties and evaluation results of the toner are shown in Tables 2 and 3, respectively. An excessively highly crosslinked component was contained to cause a thermal change with time and the toner material contacting the fixing roller became rigid to damage the fixing roller.

TABLE 2

| | Extraction residue and Viscoelasticity | | | | | | | | |
|---|---|---|---|---|---|---|---|---|---|
| | Extraction residue | | | Dynamic modulus (dyn/cm$^2$) | | | Loss modulus (dyn/cm$^2$) | | |
| | (wt. %) | | Ratio | 200° C., 0.1 Hz | | | 200° C., 0.1 Hz | | |
| | 6 Hr. | 72 Hr. | 6 Hr/72 Hr. | Initial | 60 min. | 60 min/Ini. | Initial | 60 min. | 60 min/Ini. |
| Example | | | | | | | | | |
| 1 | 49.3 | 7.6 | 6.5 | $7.7 \times 10^3$ | $7.9 \times 10^3$ | 1.03 | $5.4 \times 10^3$ | $5.5 \times 10^3$ | 1.02 |

TABLE 2-continued

| | Extraction residue and Viscoelasticity | | | | | | | | |
|---|---|---|---|---|---|---|---|---|---|
| | Extraction residue | | | Dynamic modulus (dyn/cm$^2$) | | | Loss modulus (dyn/cm$^2$) | | |
| | (wt. %) | | Ratio | 200° C., 0.1 Hz | | | 200° C., 0.1 Hz | | |
| | 6 Hr. | 72 Hr. | 6 Hr/72 Hr. | Initial | 60 min. | 60 min/Ini. | Initial | 60 min. | 60 min/Ini. |
| 2 | 35.7 | 3.7 | 9.6 | $3.9 \times 10^3$ | $4.5 \times 10^3$ | 1.15 | $2.7 \times 10^3$ | $3.0 \times 10^3$ | 1.11 |
| 3 | 67.8 | 14.2 | 4.8 | $9.1 \times 10^3$ | $9.9 \times 10^3$ | 1.09 | $3.9 \times 10^3$ | $4.0 \times 10^3$ | 1.03 |
| 4 | 38.5 | 1.0 | 38.5 | $2.8 \times 10^3$ | $4.8 \times 10^3$ | 1.71 | $2.1 \times 10^3$ | $3.3 \times 10^3$ | 1.57 |
| Comp. Example | | | | | | | | | |
| 1 | 0.0 | — | — | $2.4 \times 10^3$ | $2.0 \times 10^3$ | 0.83 | $3.1 \times 10^3$ | $3.0 \times 10^3$ | 0.97 |
| 2 | 74.7 | 46.1 | 1.6 | $4.4 \times 10^4$ | $5.5 \times 10^4$ | 1.25 | $7.5 \times 10^3$ | $8.9 \times 10^3$ | 1.19 |
| 3 | 65.7 | 11.3 | 5.8 | $6.2 \times 10^3$ | $1.6 \times 10^4$ | 2.58 | $4.3 \times 10^3$ | $1.1 \times 10^4$ | 2.56 |

TABLE 3

| | Evaluation results | | |
|---|---|---|---|
| | Fixability | Toner flowout* | Intermittent test** |
| Ex. 1 | 15 | ○ | no problem |
| Ex. 2 | 16 | ○ | " |
| Ex. 3 | 17 | ○ | " |
| Ex. 4 | 19 | Δ | " |
| Comp. Ex. 1 | 16 | X | **1 |
| Comp. Ex. 2 | 24 | ○ | **2 |
| Comp. Ex. 3 | 19 | ○ | **3 |

*Image stain due to toner flowout was evaluated.
○: No image stain.
Δ: Slight image stain but practically acceptable.
X: Noticeable image stain.
**1: Image stain occurred due to cleaning failure on the fixing roller.
**2: Fine scars occurred on the fixing roller.
**3: Image stain occurred due to scars on the fixing roller.

As described above, according to the toner and the fixing method of the present invention, the following advantages are attained.

(1) Free from the toner flowout from the fixer cleaning member.

(2) The fixing roller is not damaged by the toner material attached to parts contacting the fixing roller.

(3) Sufficient anti-offset characteristic is accomplished without impairing the fixability.

What is claimed is:

1. A fixing method comprising:

feeding a toner-receiving material carrying a toner image on a surface thereof, the toner comprising a binder resin and a colorant, wherein the binder resin contains (a) a first component of a low molecular weight in amounts of less than 80 wt. % detectable as an extract in 6 hours of extraction, and (b) a second component in amounts of at least 20 wt. % detectable as an extraction residue after 6 hours of extraction, said second component including (c) a third component of a tetrahydrofuran-non-extractable matter in amounts of below 20 wt. % detectable as an extraction residue after 72 hours of extraction; each said extraction being a Soxhlet extraction with tetrahydrofuran, wherein the toner shows a dynamic modulus and a loss modulus, respectively at 200° C. and 0.1 Hz, which are substantially unchanging with time;

passing the toner-receiving material carrying the toner image between a heated fixing roller and a pressing roller to fix the toner image under heating and pressing onto the surface of the toner-receiving material; and cleaning the fixing roller surface with a cleaning member.

2. The fixing method according to claim 1, wherein the fixing roller surface is cleaned with a cleaning web.

3. The fixing method according to claim 1, wherein the fixing roller surface is cleaned with a cleaning web impregnated with silicone oil.

4. The fixing method according to claim 1, wherein the fixing roller surface is cleaned with a cleaning pad.

5. The fixing method according to claim 1, wherein the fixing roller surface is cleaned with a cleaning pad impregnated with silicone oil.

6. The fixing method according to claim 1, wherein the fixing roller surface is cleaned with a cleaning roller.

7. The fixing method according to claim 1, wherein the fixing roller surface is cleaned with a cleaning roller impregnated with silicone oil.

8. The fixing method according to claim 1, wherein the toner image is fixed under contact with the fixing roller having a surface temperature of 150°–250° C.

9. The fixing method according to claim 1, wherein the toner image is fixed under contact with the fixing roller having a surface temperature of 150°–230° C.

10. The fixing method according to claim 1, wherein the toner image is fixed under heating and an abutting pressure of at least 1 kg/cm$^2$ acting between the fixing roller and the pressing roller.

11. The fixing method according to claim 1, wherein the extraction residue after 6 hours is at least 2 times the extraction residue after 72 hours.

12. The fixing method according to claim 1, wherein the toner shows a dynamic modulus of $1\times10^3$–$1\times10^5$ dyn/cm$^2$ and a loss modulus of $1\times10^2$–$5\times10^4$ dyn/cm$^2$ as respectively measured at 200° C. and 0.1 Hz, and the dynamic modulus is larger than the loss modulus.

13. The fixing method according to claim 1, wherein the extraction residue after 6 hours is 20–80 wt. % of the binder resin.

14. The fixing method according to claim 1, wherein the extraction residue after 6 hours is 25–70 wt. % of the binder resin.

15. The fixing method according to claim 1, wherein the extraction residue after 72 hours is below 15 wt. % of the binder resin.

16. The fixing method according to claim 1, wherein the extraction residue after 6 hours is 2–30 times the extraction residue after 72 hours.

17. The fixing method according to claim 1, wherein the moduli measured after holding the toner for 60 min. at 200° C. are below two times the moduli before the holding.

18. The fixing method according to claim 1, wherein the moduli measured after holding the toner for 60 min. at 200° C. are within the range of from 0.5 to below 2 times the moduli before the holding.

19. The fixing method according to claim 1, wherein the moduli measured after holding the toner for 60 min. at 200° C. are within the range of 0.8–1.8 times the moduli before the holding.

20. The fixing method according to claim 1, wherein said binder resin comprises a vinyl polymer, a vinyl copolymer, or a mixture thereof.

21. The fixing method according to claim 1, wherein said binder resin comprises a crosslinked vinyl polymer, a crosslinked vinyl copolymer, or a mixture thereof.

22. The fixing method according to claim 1, wherein said binder resin comprises a styrene polymer, a styrene copolymer, or a mixture thereof.

23. The fixing method according to claim 1, wherein said binder resin comprises a crosslinked styrene polymer, a crosslinked styrene copolymer, or a mixture thereof.

24. The fixing method according to claim 1, wherein said binder resin comprises a vinyl polymer, a vinyl copolymer or a mixture thereof having JIS acid value of at most 100 mgKOH/g.

25. The fixing method according to claim 1, wherein said binder resin comprises a vinyl polymer, a vinyl copolymer or a mixture thereof having a JIS acid value of 2–70 mgKOH/g.

26. The fixing method according to claim 1, wherein said binder resin comprises a vinyl polymer, a vinyl copolymer or a mixture thereof having a JIS acid value of 5–60 mgKOH/g.

27. The fixing method according to claim 1, wherein said binder resin comprises a polyester resin.

28. The fixing method according to claim 1, wherein said binder resin comprises a polyester resin having a JIS acid value of at most 100 mgKOH/g.

29. The fixing method according to claim 1, wherein said binder resin comprises a polyester resin having a JIS acid value of at most 50 mgKOH/g.

30. The fixing method according to claim 1, wherein said binder resin contains an ultra-high molecular weight component formed by melt-kneading a resin material containing a THF-insoluble and highly crosslinked high molecular weight having a carboxyl group together with a metal-containing compound linkable with the carboxyl group to sever the crosslinked high molecular weight component and cause re-crosslinking of the severed crosslinked high-molecular weight component with the metal-containing compound.

31. The fixing method according to claim 1, wherein said binder resin contains an azo metal complex represented by the following formula:

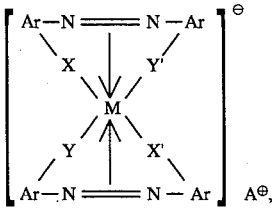

wherein M denotes a coordination center metal, inclusive of metal elements having a coordination number of 6, such as Sc, Ti, V, Cr, Co, Ni and Fe; Ar denotes an aryl group, such as phenyl or naphthyl, capable of having a substituent, examples of which may include: nitro, halogen, carboxyl, anilide, and alkyl and alkoxy having 1–18 carbon atoms; X, X', Y and Y' independently denote —O—, —CO—, —NH—, or —NR— (wherein R denotes an alkyl having 1–4 carbon atoms; and $A^{\oplus}$ denotes hydrogen, sodium, potassium, ammonium or aliphatic ammonium).

32. The fixing method according to claim 1, wherein said binder resin contains an organic acid metal complex represented by the following formula:

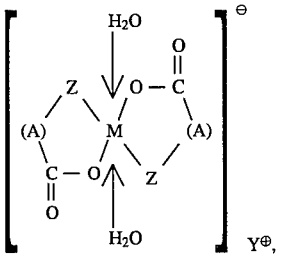

wherein M denotes a coordination center metal, inclusive of metal elements having a coordination number of 6, such as Cr, Co, Ni and Fe; A denotes

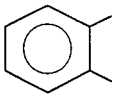

capable of having a substituent,

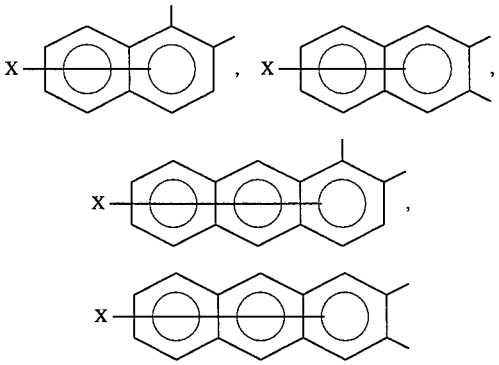

(X denotes hydrogen, halogen, or nitro),

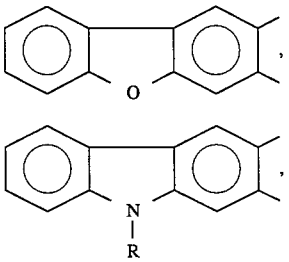

-continued
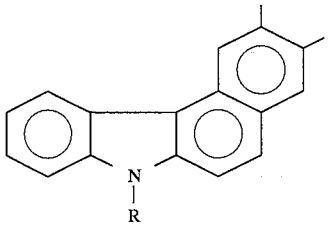
(R denotes hydrogen, $C_1$–$C_{18}$ alkyl or $C_1$–$C_{18}$ alkenyl); $Y^{\oplus}$ denotes a counter ion, such as hydrogen, sodium, potassium, ammonium, or aliphatic ammonium; and Z denotes —O— or —CO•O—.
33. The fixing method according to claim 1, wherein the third component in the toner is contained in an amount of 1 to 14.2 wt. % based on the binder resin.
* * * * *

UNITED STATES PATENT AND TRADEMARK OFFICE

CERTIFICATE OF CORRECTION

PATENT NO. : 5,500,318

DATED : March 19, 1996

INVENTOR(S) : HIROHIDE TANIKAWA ET AL.

It is certified that error appears in the above-identified patent and that said Letters Patent is hereby corrected as shown below:

COLUMN 2

Line 53, "JP-A 63214760," should read --JP-A 63-214760,--.

COLUMN 5

Line 19, "will" should read --well--.

COLUMN 6

Line 38, "modulis" should read --modulus--.

COLUMN 7

Line 23, "resin,a" should read --resin, a--.
Line 31, "Soxhlet's" should read --Soxhlet--.
Line 50, "rand" should read --and--.

COLUMN 8

Line 59, "acrylate;" should read --acrylate,--.
Line 60, "late;" should read --late,--.

COLUMN 9

Line 1, "acryronitrile," should read --acrylonitrile,--.

UNITED STATES PATENT AND TRADEMARK OFFICE

CERTIFICATE OF CORRECTION

PATENT NO. : 5,500,318

DATED : March 19, 1996

INVENTOR(S) : HIROHIDE TANIKAWA ET AL. Page 2 of 3

It is certified that error appears in the above-identified patent and that said Letters Patent is hereby corrected as shown below:

COLUMN 12

Line 2, "$Fe^{2+}Co^{2+}$," should read --$Fe^{2+}$, $Co^{2+}$,--.
Line 41, "Ni Mn" should read --Ni, Mn--.

COLUMN 14

Line 32, "Ni Mn" should read --Ni, Mn--.
Line 55, "hydrogen alkyl," should read --hydrogen, alkyl,--.

COLUMN 22

Line 52, "contained" should read --obtained--.

UNITED STATES PATENT AND TRADEMARK OFFICE

CERTIFICATE OF CORRECTION

PATENT NO. : 5,500,318

DATED : March 19, 1996

INVENTOR(S) : HIROHIDE TANIKAWA ET AL. Page 3 of 3

It is certified that error appears in the above-identified patent and that said Letters Patent is hereby corrected as shown below:

COLUMN 25

Line 23, "JIS" should read --a JIS--.

Signed and Sealed this

Twenty-second Day of October, 1996

Bruce Lehman

*Attest:*

BRUCE LEHMAN

*Attesting Officer*

*Commissioner of Patents and Trademarks*